US007405513B2

(12) United States Patent
Lee

(10) Patent No.: US 7,405,513 B2
(45) Date of Patent: Jul. 29, 2008

(54) ELECTRON EMISSION DEVICE AND MANUFACTURING METHOD THEREOF

(75) Inventor: Soo-Joung Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 226 days.

(21) Appl. No.: 11/140,358

(22) Filed: May 26, 2005

(65) Prior Publication Data

US 2005/0264169 A1 Dec. 1, 2005

(30) Foreign Application Priority Data

May 31, 2004 (KR) ..... 10-2004-0039184

(51) Int. Cl.
*H01J 1/62* (2006.01)

(52) U.S. Cl. ..... 313/496; 313/495

(58) Field of Classification Search ..... 313/309–311, 313/495–497

See application file for complete search history.

(56) References Cited

U.S. PATENT DOCUMENTS 5,547,411 A 8/1996 Lee
5,986,398 A * 11/1999 Makino ..... 313/495
6,135,841 A 10/2000 Mackey
6,255,773 B1 7/2001 Powers et al.
2004/0066132 A1* 4/2004 Cho et al. ..... 313/495

FOREIGN PATENT DOCUMENTS

JP 2002-124199 4/2002
JP 2003-346647 12/2003

OTHER PUBLICATIONS

European Search Report, dated Oct. 18, 2005, for Application No. 05104588.8, in the name of Samsung SDI Co., Ltd.
Patent Abstracts of Japan for Publication No. 2002124199, Date of publication of application Apr. 26, 2002, in the name of Tokiko Takahashi.
Patent Abstracts of Japan for Publication No. 2003346647; Date of publication of application Dec. 5, 2003, in the name of Takeshi Hirai.

* cited by examiner

*Primary Examiner*—Joseph L William
(74) *Attorney, Agent, or Firm*—Christie, Parker & Hale, LLP

(57) ABSTRACT

An electron emission device includes a first substrate and a second substrate facing each other and forming a vacuum vessel. An electron emission region is provided on the first substrate, and a light-emitting region having a light-emitting area and a non-light-emitting area is provided on the second substrate. The light-emitting region includes at least one phosphor layer formed on the second substrate. At least one anode covers the phosphor layer. The anode is also positioned such that there is no gap between the anode and the non-light-emitting area. The shape of the anode in light-emitting areas follows the shape of the phosphor layer with a gap between the anode and the phosphor layer.

10 Claims, 3 Drawing Sheets

ELECTRON EMISSION DEVICE AND MANUFACTURING METHOD THEREOF

CROSS-REFERENCE TO RELATED APPLICATION

This application claims priority to and the benefit of Korean Patent Application No. 10-2004-0039184 filed on May 31, 2004 in the Korean Intellectual Property Office, the entire disclosure of which is incorporated herein by reference.

BACKGROUND OF THE INVENTION

1. Field of the Invention

The present invention relates to an electron emission device and a method of manufacturing the same, and more particularly, to an electron emission device with a light-emitting region having thin metal film capable of improving brightness and color purity of screen and a manufacturing method of the same.

2. Description of the Related Art

Generally, electron emission devices include hot or cold cathodes as electron-providing sources. Among the known electron emission devices having cold cathodes are the field emitter array (FEA) type, the metal-insulator-metal (MIM) type, the metal-insulator-semiconductor (MIS) type, the surface conduction emitter (SCE) type, and the ballistic electron surface emitter (BSE) type. While these electron emission devices are different from each other in terms of specific structure, each generally includes an electron emission source for emitting electrons in a vacuum vessel, and a light-emitting region having phosphor layers facing the electron emission unit to emit light and display desired images.

SUMMARY OF THE INVENTION

An electron emission device includes a first substrate having an electron emission region and electrodes controlling electron emission from the region, and a second substrate having a phosphor layer, a black layer for improving contrast of a screen, and an anode for making electrons emitted from the electron emission region of the first substrate accelerate effectively to the phosphor layer thereon. The anode may be formed as a thin metal film covering the phosphor layer and black layer or as a transparent electrode positioned between a light-emitting region including the phosphor layer and black layer, i.e., on one surface of the second substrate facing a vacuum vessel.

The thin metal film covering the phosphor layer and the black layer is formed by forming an intermediate layer as a surface flattening layer on the phosphor layers formed on the second substrate, and vapor-depositing aluminum on the intermediate layer to form the anode. Because the intermediate layer is removed by firing it is not left on the second substrate and the thin metal film after the firing is spaced away from the phosphor layers and the black layers with a predetermined gap. The electron emission device and manufacturing method of the same is such that the shape of the thin metal film is easy to control, the flow of the electrons is made easy, and the brightness and color purity increase, by controlling the height of a surface flattening layer.

In one exemplary embodiment of the present invention, the electron emission device provided includes first and second substrates facing each other and forming a vacuum vessel; an electron emission unit formed on the first substrate; and a light-emitting region formed on the second substrate. The light-emitting region includes at least one phosphor layer formed on the second substrate, and at least one anode covering the phosphor layer on the second substrate. The anode is formed on the second substrate without leaving any gap at non-light-emitting areas. The shape of the anode conforms to the shape of the phosphor layer at light-emitting areas.

In another exemplary embodiment of the present invention, an electron emission device includes first and second substrates facing each other and forming a vacuum vessel; an electron emission unit formed on the first substrate; and a light-emitting region formed on the second substrate. The light-emitting region includes at least one anode formed on the second substrate; at least one phosphor layer formed on the anode; and at least one thin metal film covering the phosphor layer and anode. The thin metal film is formed without leaving any gap with respect to the anode at non-light emitting areas. The shape of the thin metal film conforms to the shape of the phosphor layer at light-emitting areas.

In yet another embodiment of the present invention, a method of manufacturing an electron emission device includes the steps of: (a) forming at least one phosphor layers on the substrate, corresponding to the light-emitting areas defined on the second substrate; (b) forming a surface flattening layer on a surface of the phosphor layer by coating a composition for forming a intermediate layer except at the non-light-emitting areas defined on the second substrate; (c) forming at least one anode of thin metal film on the entire surface of the second substrate on which the surface flattening layer is formed; and (d) removing the surface flattening layer by firing the second substrate.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION

The present invention will be described more fully hereinafter with reference to the accompanying drawings, in which preferred embodiments of the invention are shown.

Figure 1:
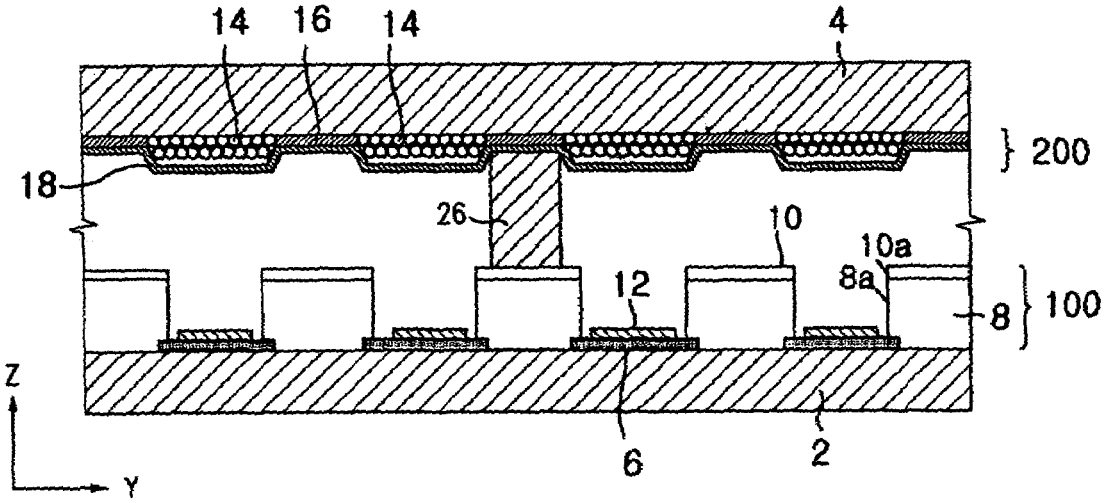
FIG. 1 is a cross-sectional view of an electron emission device according to one embodiment of the present invention.

Referring now to FIG. 1, the electron emission device includes a vacuum vessel constructed of a first substrate 2 and a second substrate 4 sealed to each other, and being substantially parallel with a predetermined space therebetween.

An electron emission unit 100 of the first substrate 2 emits electrons towards the second substrate 4, and a light-emitting region 200 of the second substrate 4 emits visible light to display an image.

The electron emission unit 100 may be implemented in any known construction of an electron emission device. In FIG. 1, an FEA type electron emission device is provided as one exemplary embodiment.

As shown in the electron emission device of FIG. 1, a plurality of cathodes 6 are formed in a predetermined pattern, for example, in a stripe pattern with a certain stripe gap between each stripe on the first substrate 2. An insulating layer 8 is formed covering cathodes 6. On the insulating layer 8, a plurality of gate electrodes 10 having a predetermined pattern, for example a stripe pattern, are formed in a direction substantially perpendicular to the cathodes 6, with a certain gap between each stripe.

As shown in FIG. 1, if an area where the cathodes 6 and gate electrodes 10 cross is defined as a pixel area, an insulating layer with at-least one opening 8*a*, 10*a* is formed for each pixel area in the insulating layer 8 and gate electrode 10, and thus some part of the surface of the cathodes 6 is exposed and the electron emission region 12 is formed on the exposed cathodes 6.

The electron emission region 12 includes an electron emitting material which emits electrons when an electric field is applied thereto, such as carbon nanotubes, graphite, diamond, diamond-like carbon, fullerene (C60), silicon nanowire, or a combination thereof, or a metal material such as molybdenum. The electron emission region is formed by a method such as screen printing, photolithography, chemical vapor deposition (CVD), sputtering, and the like.

A scan signal is applied to either electrode of the cathode 6 and the gate electrode 10, and a data signal is applied to the other electrode. An electric field is generated around the electron emission source 12 in the pixel having a voltage difference between the two electrodes of more than a threshold voltage, and thus electrons are emitted.

Of note is that the constitution of the electron emission unit 100 is not limited to the aforementioned embodiment. For example, the gate electrode may first be formed on the first substrate and the cathode may then be formed on the gate electrode, with an insulating layer between the cathode and gate electrodes. The electron emission region is electrically connected with the cathode.

In FIG. 1, the electron emission unit of the FEA type electron emission device is illustrated as one example of an electron emission unit. However, the electron emission unit 100 is not limited thereto, and electron emission units of SCE, MIN, MIS, and BSE electron emission devices can also implement the present invention.

At least one phosphor layer 14 is formed on one side of the second substrate 4, corresponding to the first substrate 2, A black layer 16 may be formed at the non-light-emitting areas between the phosphor layers 14 for heightening the screen contrast. The black layer 16 may be formed with a thin film based on chrome oxide, or with a thick film of a carbonaceous material, such as graphite. At least one anode 18 is formed on the black layer 16 and the phosphor layer 14 to constitute a light-emitting region 200.

In an exemplary embodiment the anode 18 is formed as a thin metal film by vapor deposition or sputtering of a metal, such as a thin aluminum film. When a high voltage is applied to the thin metal film, it is used as an anode to accelerate the electron beam.

Where the anode 18 is formed at areas corresponding to the non-light-emitting areas, such as at the black layers 16, the anode 18 is adhered to the black layers 16 without leaving any gap. When the anode 18 and black layer 16 contact each other, electrons can flow easily resulting in improvement of discharge, and the electric charges on the phosphor layer easily move to the black layer through the thin metal film. The anode 18 having the above structure may be formed by direct vapor deposition of the metallic material on the black layer 16.

On the other hand, the anode 18 is placed apart from the surface of the phosphor layers 14 with a predetermined gap. Such a gap is made by removing an intermediate layer (not shown) formed on the phosphor layers 14 through the firing, separating the anode 18 from the phosphor layers 14. Therefore, a predetermined space is made between the phosphor layers 14 and the anode 18, whereas the black layers 16 and the anode 18 directly contact each other.

According to the first embodiment of the present invention, the anode may be formed on the phosphor layer for improving the brightness and color appearance of an electron emission device. The anode is formed with the colors of the phosphor layer being separated from each other by regulation of the surface flattening layer of the intermediate layer. That is to say, the colors of the phosphor layers are divided apart from each other. The anode in accordance with the present invention is not formed relatively flat with respect to the entire second substrate, but is formed following the shape of the phosphor layer with temporary intermediate layer and the black layer, the temporary intermediate layer being a surface flattening layer formed on only phosphor layers followed by vapor deposition of the thin metal film. Because the surface flattening layer is removed after firing, the anode maintains the shape of the intermediate layer/surface flattening layer. The shape of the anode can also controlled to provide right-angles, half-circles, and serrations, but its shape is not limited thereto.

In the electron emission device according to the first embodiment, the anode is formed with the same shape as the shape of the surface of the phosphor layer, so the scattered light and the second electrons generated from one phosphor layer are limited in only one phosphor layer and cannot move to another phosphor layer, resulting in improvement of the brightness and color purity of the device.

According to the electron emission device of the present invention, since the brightness is affected by the anode, the distance between the phosphor layer and the anode may be regulated by controlling the height of the surface flattening layer formed on a certain phosphor layer resulting in control of the brightness and the brightness ratio of the phosphor material. In an exemplary embodiment the distance between the phosphor layer and the anode may be controlled to be in the range from 100 nm to 10 μm by forming the surface flattening layer on at least one phosphor layer.

Figure 2:
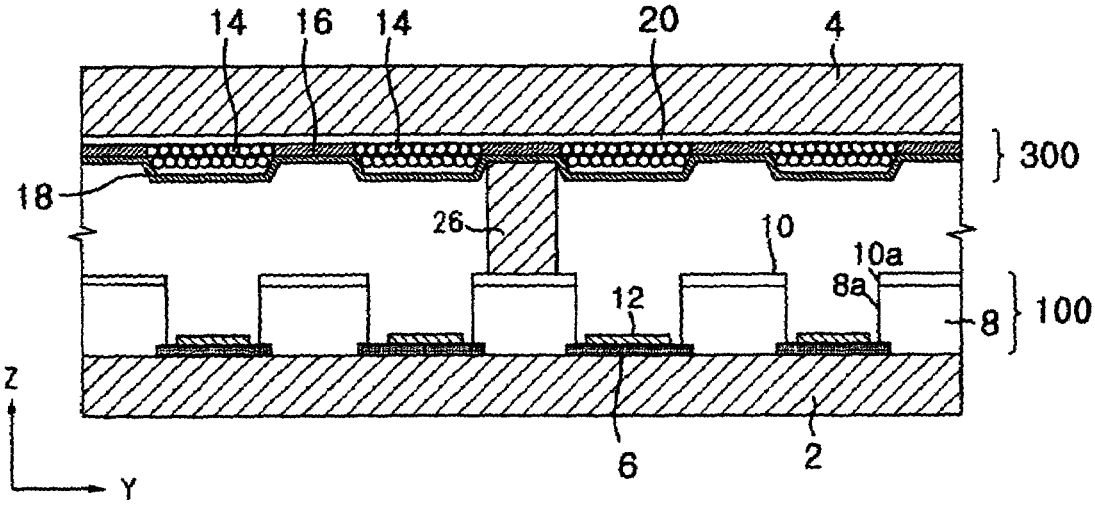
FIG. 2 is a cross-sectional view of an electron emission device according to another embodiment of the present invention.

FIG. 2 is a cross-sectional view of an electron emission device according to a second embodiment of the present invention. The electron emission device according to the embodiment has the same structure of electron emitting unit 100 and the light-emitting region 300 as the first embodiment, except for an additional anode and therefore the same members have the same reference numbers.

As shown in FIG. 2, the light-emitting region 300 of the electron emission device according to the second embodiment of the present invention includes at least one anode 20 formed on the second substrate 4; at least one phosphor layer 14 formed on the anode 20; and at least one thin metal film anode 18 formed covering the phosphor layer 14 and anode 20.

The light-emitting region 300 therefore has the anode 20 placed between the phosphor layer 14 and the second substrate 4. The anode 20 is a transparent electrode which is formed using a transparent oxide, for example Indium Tin Oxide (ITO). The anode 20 is formed on the entire surface of the second substrate 4 or is formed with various shapes, for example in a stripe pattern.

According to the second embodiment, the electron emission device is different from that of the first embodiment in that the voltage for accelerating the electron beam is supplied to the anode 20 and to the thin metal film anode 18 which heightens the screen brightness by a metal back effect.

The black layer 16 for heightening the screen contrast is preferably placed on the non-light-emitting areas between the phosphor layers 14 on the light-emitting areas. The phosphor layer 14 can be formed on the patterned anode 20 where it is not useful to form a black layer.

Referring to both FIGS. 1 and 2, the electron emission unit 100 is formed on the first substrate 2, and a light-emitting region 200 or 300 is formed on the second substrate 4. After spacers 26 are arranged on the electron emission unit 100, the peripheries of the first and second substrates are sealed to each other with a sealant, and the internal space surrounded by the first and second substrates is exhausted through an exhaust port (not shown), thereby completing an electron emission device.

At least one red, green, and blue phosphor layers may be spaced apart from each other without black layers. In this case, the anode or thin metal film is placed on the anode between the phosphor layers while being tightly adhered thereto without leaving any gap.

The constitution of the electron emission unit in accordance with the present invention is not limited to the aforementioned embodiments. For example, the gate electrode may first be formed on the entire surface of the first substrate, with the cathode then being formed on the gate electrode with an insulating layer between the cathode and gate electrodes. The cathode and gate electrodes may be formed in crossed stripe patterns.

When the anode is formed in a stripe pattern, and phosphor layers are formed on the anode without a black layer, and a part of the metallic film is placed directly on the second substrate between the phosphor layers while being tightly adhered thereto without leaving any gap.

A method of manufacturing the flat panel display according to an exemplary embodiment of the present invention will now be explained with reference to FIGS. 3A to 3D.

Figure 3A:
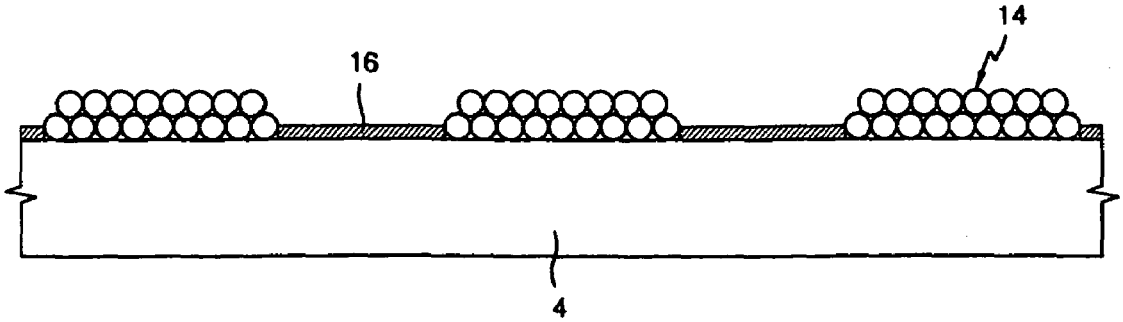
FIGS. 3A, 3B, 3C and 3D schematically illustrate the steps of manufacturing the electron emission device according to an exemplary embodiment of the present invention.

As shown in FIG. 3A, black layers 16 are formed on the second substrate 4 at the non-light-emitting areas. The black layers 16 may be formed with a thin film, such as a chrome oxide thin film, or with a thick film of a carbonaceous material, such as graphite.

Red, green, and blue phosphor layers 14 are formed between the black layers 16 at the light-emitting area.

Figure 3B:
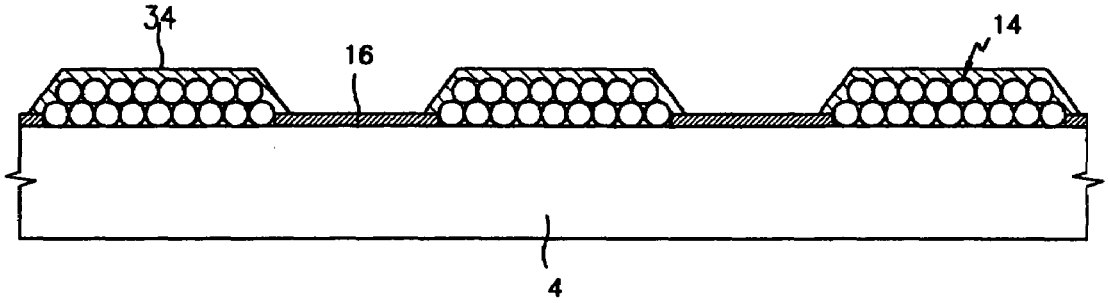

The location where an anode is to be formed without leaving any gap with respect to the black layer 16 is determined, and as shown in FIG. 3B, an intermediate layer 34 as a surface flattening layer is selectively formed on the phosphor layer 14 except at the above location.

The composition forming the intermediate layer includes a binder resin and a solvent. In exemplary embodiments the binder resin may be at least one selected from the group consisting of acryl resin, epoxy resin, ethyl cellulose, nitro cellulose, urethane resin, and ester resin. In exemplary embodiments the solvent may be at least one selected from the group of butyl cellosolve (BC), butyl carbitol acetate (BCA), terpineol (TP), and alcohol. The composition may have a viscosity in the range of 30,000 to 100,000.

Figure 3C:
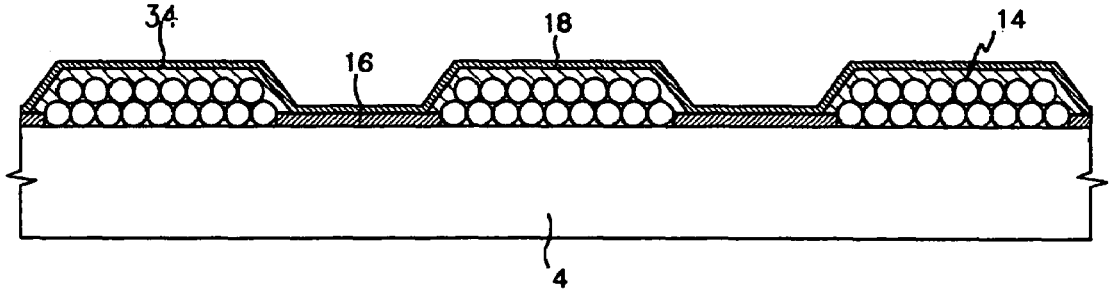

As shown in FIG. 3C, a metallic material, such as aluminum, is vapor-deposited or sputtered onto the entire surface of the second substrate 4 where the intermediate layer 34 is formed, to form an anode 18. The anode directly contacts the black layer 16 where the intermediate layer 34 is absent.

Figure 3D:
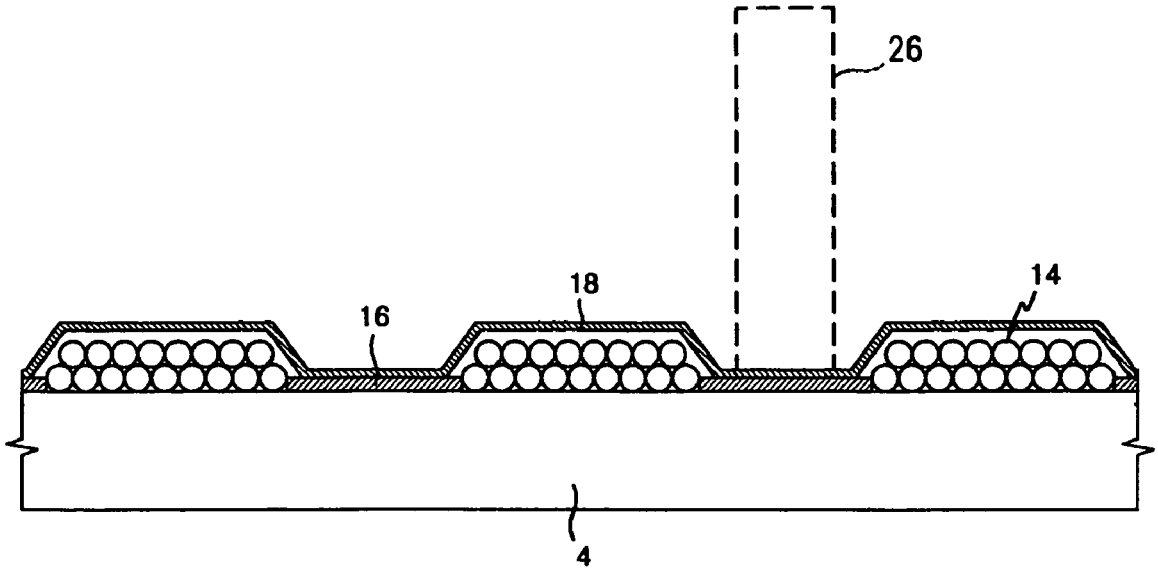

Thereafter, the second substrate 4 with the thin metal film is fired to remove the intermediate (surface flattening) layer 34. In this way, as shown in FIG. 3D, the structure of the second substrate 4 is completed. When the intermediate layer 34 is removed, the portion of the anode 18 on the phosphor layer 14 is spaced apart from the phosphor layer 14 with a predetermined gap corresponding to the intermediate layer 34, and is structurally differentiated from that of the anode 18 on the black layer 16. An exemplary temperature of the firing process is at a 400° C. to 480° C. The shape of the anode is controlled to provide right-angle, half-circle, and serration shapes and so on, by patterning the intermediate layer 34. The composition for forming a surface flattening layer is coated with a thickness of 3 to 4 μm, and the distance between the phosphor layer and the thin metal film is adjusted in the range of 100 nm to 10 μm by firing.

Finally, the gate electrode, insulating layer, cathode, and electron emission source are formed on the first substrate. After spacers are arranged on the insulating layer, the peripheries of the first and the second substrates are sealed to each other by a sealant, and the internal space surrounded by the first and the second substrates is exhausted through an exhaust port (not shown), thereby completing the electron emission device.

The anodes 20 may generally be formed in a stripe pattern using a photolithography process, and forming of black layer 16 on the second substrate 6 may be omitted.

An electron emission device in the alternate embodiment of the present invention shown in FIG. 2 is manufactured as follows: a transparent conductive layer, such as an ITO layer is formed on the second substrate to form an anode 20. Black layers 16 are formed on the anode 20 at the non-light-emitting areas. Accordingly, the light-emitting area 300 may be formed by the same method as in the aforementioned embodiment except for the anode 20.

The following examples further describe the present invention in more detail. However, it is understood that the present invention is not limited by these examples.

EXAMPLE 1

The composition for forming an intermediate layer was prepared by adding 25% by weight of ethyl cellulose to 75% by weight of terpineol (TP). The composition is optionally coated over the phosphor layer which has a structure as shown in FIG. 1 on the second substrate, not coated over the black layer. Thereafter, aluminum was vapor-deposited on the second substrate and the phosphor layer. Subsequently, the composition forming an intermediate layer is removed by firing at a temperature of 450° C. The second substrate having an electron emission unit as shown in FIG. 1 and the above fabricated first substrates are sealed to each other by a sealant, and the internal space surrounded by the first and the second substrate is exhausted through an exhaust port, thereby completing an electron emission device.

COMPARATIVE EXAMPLE 1

The composition for forming an intermediate layer as in Example 1 as coated over the phosphor layers and the black layers. Thereafter, the electron emission device was prepared by the same method as in Example 1, except that an aluminum film was formed parallel with the substrate by vapor deposition.

Table 1 and Table 2 show measurement results of brightness and color appearance according to general measurement methods as to Example 1 and 5 Comparative Example 1.

TABLE 1

| | | Va | | | |
|---|---|---|---|---|---|
| | | 3.5 kV | 4.0 kV | 4.5 kV | 5.0 kV |
| Brightness (%) | Comparative Example 1. | 100 | 100 | 100 | 100 |
| | Example 1 | 100 | 108 | 111 | 112 |

TABLE 2

| | | Va | | | |
|---|---|---|---|---|---|
| | | 3.5 kV | 4.0 kV | 4.5 kV | 5.0 kV |
| Color appearance (%) | Comparative Example 1. | 59 | 56 | 56 | 55 |
| | Example 1 | 73 | 69 | 70 | 69 |

As shown in Tables 1 and 2, the brightness and color appearance of Example 1 are better than those of Comparative Example 1.

According to the present invention, the thin metal film is formed following the shape of the phosphor layer, thereby preventing mixing of colors generated from secondary electrons and fluorescent light scattering, resulting in improvement in color purity and brightness. Further, according to the present invention, the distance of the gap between the anode and the phosphor layer having a specific color can be controlled, and the shape of the thin metal film, in one embodiment an Al reflection film, can be controlled with the intermediate layer. Further, the intermediate layer may be coated by a screen printing method and therefore is not affected by the size of the substrate, thereby allowing it to be utilized in large-sized displays.

Although exemplary embodiments of the present invention have been described in detail, it should be clearly understood that many variations and/or modifications of the basic inventive concept herein taught which may appear to those skilled in the art will still fall within the spirit and scope of the present invention, as defined in the appended claims.

What is claimed is:

1. An electron emission device comprising a first substrate and a second substrate facing each other and forming a vacuum region;

an electron emission region on the first substrate; and a light-emitting region having light-emitting areas and non-light-emitting areas on the second substrate, wherein:

the light-emitting areas include a phosphor layer on the second substrate, an anode covers the phosphor layer following a shape of the phosphor layer in the light-emitting areas with a gap between the anode and the phosphor layer while being in contact with the non-light-emitting areas, and the gap between the anode and the phosphor layer ranges from 100 nm to 10 μm.

2. The electron emission device of claim 1, further comprising black layers forming non-light-emitting areas between adjacent phosphor layers without a gap between the anode and the black layer.

3. The electron emission device of claim 1, wherein the anode is a thin metal film.

4. The electron emission device of claim 3, wherein the thin metal film is an aluminum film.

5. An electron emission device comprising a first substrate and a second substrate facing each other and forming a vacuum region;

an electron emission region on the first substrate; and a light-emitting region having light-emitting areas and non-light-emitting areas on the second substrate, wherein:

the light-emitting areas include an anode formed on the second substrate, at least one phosphor layer on the anode, a thin metal film covers the anode and the phosphor layer, the thin metal film:

being in contact with the non-light-emitting areas, and having a shape in the light-emitting areas following a shape of the phosphor layer and having a gap between the phosphor layer and the thin metal film, and the gap between the phosphor layer and the thin metal film ranges from 100 nm to 10 μm.

6. The electron emission device of claim 5, further comprising a black layer on the non-light-emitting areas between the phosphor layers without a gap between the anode and the black layer.

7. The electron emission device of claim 5, wherein the anode is a transparent electrode.

8. The electron emission device of claim 7, wherein the transparent electrode is comprised of indium tin oxide.

9. An electron emission device comprising a first substrate and a second substrate facing each other and forming a vacuum region;

an electron emission region on the first substrate; and a light-emitting region having light-emitting areas and non-light-emitting areas on the second substrate, wherein:

the light-emitting areas include a phosphor layer on the second substrate, an anode covers the phosphor layer following a shape of the phosphor layer in the light-emitting areas with a gap between the anode and the phosphor layer while being in contact with the non-light-emitting areas, the gap between the anode and the phosphor layer ranging from 100 nm to 10 μm, and a spacer contacts the anode in the non-light emitting areas.

10. An electron emission device comprising a first substrate and a second substrate facing each other and forming a vacuum region;

an electron emission region on the first substrate; and a light-emitting region having light-emitting areas and non-light-emitting areas on the second substrate, wherein:

the light-emitting areas include an anode on the second substrate, a phosphor layer is on the anode, a thin metal film covers the anode and the phosphor layer, the thin metal film:

being in contact with the non-light-emitting areas, and having a shape in the light-emitting areas following a shape of the phosphor layer and having a gap between the phosphor layer and the thin metal film, the gap between the thin metal film and the phosphor layer ranging from 100 nm to 10 μm, and a spacer contacts the thin metal film in the non-light-emitting areas.

* * * * *